US010012470B2

(12) United States Patent
Johnson

(10) Patent No.: US 10,012,470 B2
(45) Date of Patent: Jul. 3, 2018

(54) FIREARM STOCK ADJUSTMENT SYSTEM

(71) Applicant: Sig Sauer Inc., Newington, NH (US)

(72) Inventor: Adam Johnson, Epping, NH (US)

(73) Assignee: SIG SAUER, INC., Newington, NH (US)

( * ) Notice: Subject to any disclaimer, the term of this patent is extended or adjusted under 35 U.S.C. 154(b) by 0 days.

(21) Appl. No.: 15/615,337

(22) Filed: Jun. 6, 2017

(65) Prior Publication Data

US 2017/0356718 A1 Dec. 14, 2017

Related U.S. Application Data

(60) Provisional application No. 62/347,742, filed on Jun. 9, 2016.

(51) Int. Cl.
*F41C 23/14* (2006.01)
*F41C 23/20* (2006.01)

(52) U.S. Cl.
CPC ..... *F41C 23/14* (2013.01); *F41C 23/20* (2013.01)

(58) Field of Classification Search
CPC ..... F41C 23/14; F41C 23/20
USPC ..... 42/73
See application file for complete search history.

(56) References Cited

U.S. PATENT DOCUMENTS 5,149,899 A * 9/1992 Dabrowski ..... F41C 23/14 42/72
5,933,997 A * 8/1999 Barrett ..... F41C 23/14 42/73
6,779,289 B2 8/2004 Kay
2011/0283584 A1 11/2011 Walters
2014/0259848 A1 * 9/2014 Chvala ..... F41C 23/14 42/73

* cited by examiner

*Primary Examiner* — Stephen Johnson
(74) *Attorney, Agent, or Firm* — Finch & Maloney PLLC

(57) ABSTRACT

A firearm stock extension assembly enables a stock to be collapsed when a firearm is not in active use, and extended from a collapsed configuration directly to the user's preferred stock length. This is accomplished without requiring the user to actuate a lever to release a detent mechanism and without the need for hand tools to adjust the length of the stock. The firearm stock extension assembly includes an insert that defines at least one insert aperture. When properly placed, the insert aperture of the insert lines up with a corresponding extension aperture on the stock. Other than the corresponding extension aperture exposed by the insert aperture, all other extension apertures are concealed by the solid portions of the insert.

19 Claims, 6 Drawing Sheets

FIREARM STOCK ADJUSTMENT SYSTEM

This application claims priority from U.S. provisional application 62/347,742, as filed on Jun. 9, 2016.

TECHNICAL FIELD

The present disclosure relates generally to firearms. Specifically, embodiments of the present disclosure relate to firearm stock adjustment systems.

BACKGROUND

Many firearms are equipped with a stock that has an adjustable length. Sometimes referred to as an "adjustable receiver extension," this feature allows a user of a firearm to adjust a "length of pull" (i.e., a distance between a front face of a trigger and a user-confronting face of the stock) or "LOP" that better matches the physical configuration of the user's body. For example, a user with short arms (and thus a small LOP) can configure the length of the stock using an adjustable receiver extension to a shorter setting, thus customizing the LOP of the firearm to match the user's arm length. Upon adjusting the stock, the user need not stretch or strain to reach a trigger. Rather, an appropriately adjusted stock facilitates convenient use of a firearm by a user, regardless of the physical configuration of the user's body.

SUMMARY

An example disclosed herein includes a firearm stock extension assembly. The firearm stock assembly includes a stock extension having a longitudinal axis, an extension frame connected to the stock extension, the extension frame defining at least one channel and a plurality of extension apertures. The firearm stock assembly also includes an insert configured to be removably disposed within the at least one channel of the extension frame, the insert defining at least one insert aperture configured to align with at least one of the plurality of extension apertures upon insertion of the insert into the at least one channel.

In embodiments, the insert further includes a distal end, a proximal end proximate to a user contact surface of a firearm stock, the proximal end opposite the distal end, and a distal end detent feature disposed proximate to the distal end of the insert, the distal end detent feature configured to deter unintentional extension of the firearm stock extension assembly. In embodiments, the insert further includes a distal end, a proximal end proximate to a user contact surface of a firearm stock, the proximal end opposite the distal end, at least one proximal end detent feature, each proximal end detent feature disposed adjacent to each of the at least one insert apertures and between a corresponding insert aperture and the proximal end, wherein each of the at least one proximal end detent features is configured to deter unintentional over-extension of the adjustable firearm stock extension assembly beyond an adjacent corresponding at least one insert aperture. In embodiments, the firearm stock extension assembly further includes an end cap configured to mount to an open end of the at least one channel defined by the extension frame. In embodiments, the extension frame defines a threaded hole proximate to the open end and the end cap defines a through-hole configured to align with the threaded hole when the end cap is mounted to the open end of the at least one channel. In embodiments, each of the at least one insert apertures defined by the insert are ellipses, a major axis of each ellipse parallel to the longitudinal axis of the stock extension. In embodiments, each extension aperture of the plurality and each of the at least one insert apertures are configured to receive a pin of a stock detent mechanism that, when received by an extension aperture aligned with an insert aperture, locks the stock extension into a position corresponding to the extension aperture.

An example disclosed herein includes an adjustable firearm stock assembly that includes an adjustable stock. The adjustable stock includes a stock, a chamber disposed within the stock, and a detent mechanism that includes a pin. The adjustable firearm stock assembly also includes a stock extension configured to be at least partially disposed within the chamber of the adjustable stock, the stock extension having a longitudinal axis, an extension frame connected to the stock extension, the extension frame defining at least one channel and a plurality of extension apertures. The adjustable firearm stock assembly further includes an insert configured to be removably disposed within the at least one channel of the extension frame, the insert defining at least one insert aperture configured to align with at least one of the plurality of extension apertures upon insertion of the insert into the at least one channel.

In embodiments, the insert further includes a distal end, a proximal end proximate to a user contact surface of the stock, the proximal end opposite the distal end, and a distal end detent feature disposed proximate to the distal end of the insert, the distal end detent feature configured to deter unintentional extension of the adjustable firearm stock extension assembly. In embodiments, the insert further includes a distal end, a proximal end proximate to a user contact surface of the stock, the proximal end opposite the distal end, at least one proximal end detent feature, each proximal end detent feature disposed adjacent to each of the at least one insert apertures between a corresponding insert aperture and the proximal end wherein each of the at least one proximal end detent features is configured to deter unintentional over-extension of the adjustable firearm stock extension assembly beyond the adjacent corresponding at least one insert aperture. In embodiments, the adjustable firearm stock assembly further includes an end cap configured to mount to an open end of the at least one channel defined by the extension frame. In embodiments, the extension frame defines a threaded hole proximate to the open end and the end cap defines a through-hole configured to align with the threaded hole when the end cap is mounted to the open end of the at least one channel. In embodiments, each of the at least one insert apertures defined by the insert are ellipses, a major axis of each ellipse parallel to the longitudinal axis of the stock extension. In embodiments, each extension aperture of the plurality and each of the at least one insert apertures are configured to receive a pin of a stock detent mechanism that, when received by an extension aperture aligned with an insert aperture, locks the stock extension into a position corresponding to the extension aperture.

An example disclosed herein includes a firearm that includes a firing chamber, a firing pin proximate to the firing chamber, a trigger connected to the firing pin, and an adjustable stock that includes a stock, a chamber disposed within the stock, and a detent mechanism that includes a pin. The firearm also includes a stock extension configured to be at least partially disposed within the chamber of the adjustable stock, the stock extension having a longitudinal axis, an extension frame connected to the stock extension, the extension frame defining at least one channel and a plurality of extension apertures. The firearm also includes an insert configured to be removably disposed within the at least one channel of the extension frame, the insert defining at least one insert aperture configured to align with at least one of the plurality of extension apertures upon insertion of the insert into the at least one channel.

In embodiments, the insert of the firearm includes a distal end, a proximal end proximate to a user contact surface of the stock, the proximal end opposite the distal end, and a distal end detent feature disposed proximate to the distal end of the insert, the distal end detent feature configured to deter unintentional extension of the adjustable stock. In embodiments, the insert of the firearm includes a distal end, a proximal end proximate to a user contact surface of the stock, the proximal end opposite the distal end, and at least one proximal end detent feature disposed adjacent to each of the at least one insert apertures, and between a corresponding insert apertures and the proximal end, wherein each of the at least one proximal end detent feature is configured to deter unintentional over-extension of the adjustable stock beyond the adjacent corresponding at least one insert aperture. In embodiments, each of the at least one insert apertures defined by the insert are ellipses, a major axis of each ellipse parallel to the longitudinal axis of the stock extension. In embodiments, each extension aperture of the plurality and each of the at least one insert apertures are configured to receive a pin of a stock detent mechanism that, when received by an extension aperture aligned with an insert aperture, locks the stock extension into a position corresponding to the extension aperture.

BRIEF DESCRIPTION OF THE DRAWINGS

FIG. 3B' is an end view of the firearm stock extension assembly shown in FIG. 3B, in an embodiment.

Figure 1:
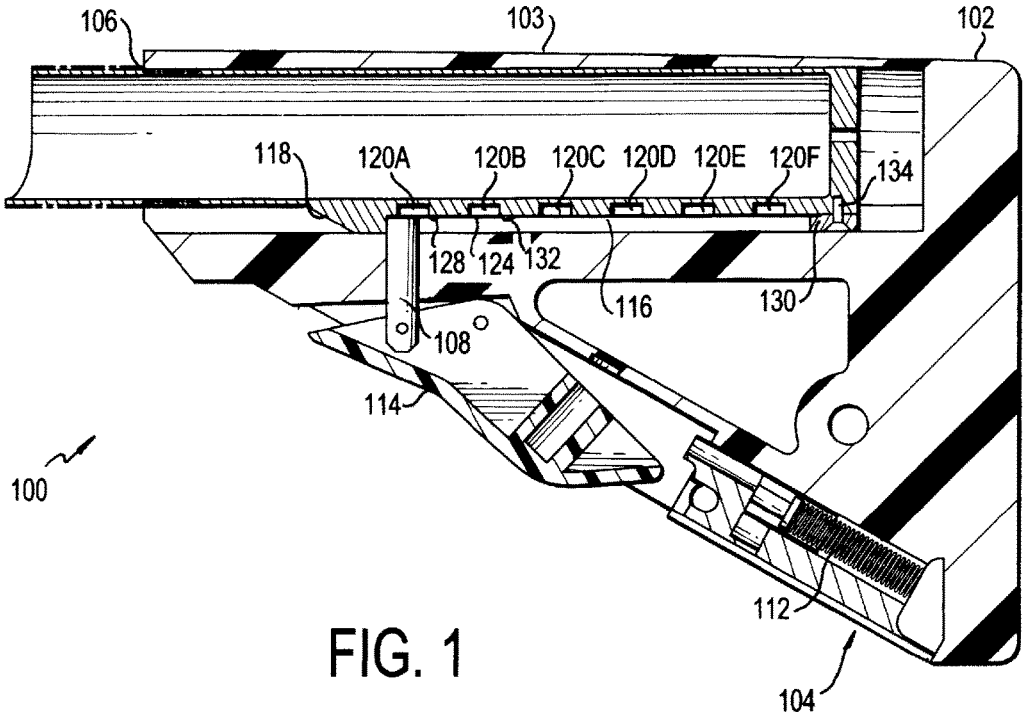
FIG. 1 is a transparent side-view of a firearm that includes a firearm stock extension assembly, in which the firearm stock extension is in a collapsed configuration, in an embodiment.

The figures depict various embodiments of the present disclosure for purposes of illustration only. Numerous variations, configurations, and other embodiments will be apparent from the following detailed discussion.

DETAILED DESCRIPTION

Overview

Adjustable length firearm stocks can be thought of as belonging to one of two broad categories. In the first category, an adjustable stock is extended to a preferred length, and locked at the preferred length using a fixture that is secure and not easily releasable. Analogous to a fixed-length stock conventionally used in long barrel firearms, the adjustable stock remains at the locked preferred position throughout all service conditions (e.g., when the firearm is being aimed or fired, when the firearm is being stored, when the firearm is being held or slung about the user, but not aimed or fired). One example of an adjustable length firearm stock in this first category appears in U.S. Pat. No. 6,779,289.

This first category of adjustable length firearm stock is, for some applications, an improvement over conventional un-adjustable, fixed-length stocks. However, an adjustable length stock that is not spontaneously adjustable (e.g., the adjustment requires hand tools or the disengagement/re-engagement of screws, bolts, or other similar hardware) during different service conditions (e.g., carrying versus firing the firearm) can make the firearm more unwieldy and/or less convenient to use under certain conditions. For example, a soldier that is on patrol but not actively aiming or firing his firearm must still carry and manipulate the entire length of the firearm, including the extended length of the not-spontaneously adjustable stock. This can be problematic because, for example, carrying a longer firearm moves the center of mass of the firearm away from the center of mass of the user, thus increasing fatigue from carrying the firearm. In another example, carrying a longer firearm increases the distance that the end of the barrel of the firearm must travel to be aimed (and increases the moment of inertia needed for aiming the firearm), thus increasing the response time and the exertion needed to aim the firearm.

In the second category of adjustable length firearm stocks, a length of a stock can be spontaneously adjusted (i.e., without the use of hand tools) using a releasable mechanism. For example, a detent mechanism on a stock can include a lever (or other mechanism) that engages and disengages a pin with various corresponding extension locations (often holes or other features configured to receive the pin) defined within the stock. This detent mechanism (e.g., the combination of the lever, the pin, the extension locations form, among other elements) enables a user to collapse the stock when the firearm is not in use and extend the stock when the firearm is in use. However, actuating the lever to disengage the pin, extending the stock to a preferred length, and re-actuating the lever to engage the pin with an extension location defined by the stock, thus locking the adjustable stock at a length, is not only inconvenient and slow, it is also prone to error. A user, particularly a user under stress (e.g., the stress of combat), is prone to misadjust the length of the adjustable stock. This misadjustment then requires re-adjustment to configure the stock to the preferred length or requires using the firearm having an LOP that is too short or too long.

Embodiments of the present disclosure include a firearm stock extension assembly that enables the stock to be collapsed when the firearm is not in active use, and extended to the user's preferred stock length directly from the collapsed configuration. Extending a stock using embodiments described herein does not require the user to actuate a lever to release a detent mechanism or use hand tools to extend the length of the stock to a preferred length. Furthermore, the embodiments described herein reduce a risk of extending the stock beyond a stock length that is preferred by a user.

These benefits are accomplished, in part, by using an insert that defines at least one insert aperture. The insert is inserted into a frame of a stock assembly that also includes extension apertures configured to receive a pin of a detent mechanism used for locking a stock extension into position. When placed into the extension frame, the insert aperture of the insert lines up with a corresponding extension aperture. Other than the extension aperture exposed by the insert aperture, all other extension apertures are concealed by solid portions of the insert. Thus, there is only one possible extension location with which the pin of the detent mechanism can engage. This configuration enables a collapsed stock to be extended quickly and without hesitation to the preferred length because a pin of a detent mechanism (commonly found in adjustable stocks) cannot engage with those extension locations of the frame concealed by the solid portions of the insert.

Furthermore, each insert includes a distal end (i.e., an end closer to the open end of a barrel on the firearm) detent feature. This distal end detent feature is a positive salient feature on a side of the insert facing the pin of the detent mechanism. The distal end detent feature is configured to act as a catch or impediment that contacts the pin of the detent mechanism when the firearm stock extension is in its collapsed position. The contact between the pin and the distal end detent provides (1) enough resistance to translation of the extendable firearm stock that the firearm stock is not unintentionally extended (e.g., by the gravity force exerted on the mass of the firearm itself when the stock is held and the firearm is unsupported) but (2) not so much resistance that the resistance cannot be overcome by intentional extension of the firearm stock by the user.

Each insert also includes at least one proximal end (i.e., an end closer to a shoulder pad or other user-confronting end surface of the stock) detent feature disposed between each insert aperture and a proximal end of the insert. The proximal end detent feature is disposed adjacent to each aperture. The proximal end detent feature acts as an added barrier to prevent over-extension of the stock beyond the insert aperture corresponding to a preferred length of the stock.

Firearm With Firearm Stock Extension Assembly

FIG. 1 illustrates a transparent side-view of a portion of a firearm that includes a firearm stock extension assembly, in which the firearm stock extension is in a collapsed configuration, in an embodiment. Included in the embodiment of FIG. 1 are a firearm stock 100 and a stock extension assembly 106.

The firearm stock 100 in this embodiment includes a shoulder pad 102, a hollow frame 103, and a detent mechanism 104. The shoulder pad 102 is used as a user contact surface between the shoulder (or proximate area) of the user and the firearm itself. As is known, the shoulder pad 102 can include padding or other features that increase the comfort of the user when firing the firearm. The shoulder pad 102, when used in cooperation with other elements of a firearm, can also improve the stability of the firearm during aiming and firing.

The hollow frame 103 of the firearm stock 100 provides a structure on which the various elements of the firearm stock 100 can be attached, including the shoulder pad 102 and the detent mechanism 104, among other elements not shown or described for clarity of explanation. The hollow frame 103 also defines a chamber into which the stock extension assembly 106 is received in a collapsed state and from which the stock extension assembly 106 can be extended, as will be described below in more detail.

The example detent mechanism 104 shown in the firearm stock 100 is used to lock and unlock the stock at a selected length of extension along the extension assembly 106. The example detent mechanism includes a pin 108, a spring 112, and an actuator 114. The pin 108 is engaged and disengaged from one or more of extension apertures (120A-120F) associated with the stock extension assembly 106 using the actuator 114 to which the pin 108 is connected. The actuator 114 is urged in one direction (e.g., open) by the spring 112 and urged in another direction (e.g., closed) by a spring (not shown) with a component of force approximately perpendicular to the biasing force applied by the spring 112.

The stock extension assembly 106 includes an insert 116 and a frame 118. The frame 118 defines a plurality of extension apertures 120A-F. The extension apertures 120A-F are individually used to releasably lock the stock extension assembly 106 at a selected length of extension by inserting the pin 108 of the detent mechanism 104 into one of the extension apertures 120A-F.

In the example shown in FIG. 1, the stock extension assembly 106 is disposed within the chamber of the hollow frame 103 in a collapsed configuration. This collapsed configuration corresponds to an alignment of the pin 108 with the extension aperture 120A. That is, a maximum length of the stock extension assembly 106 is disposed within the chamber of the hollow frame 103, thus configuring the firearm in a length than if the stock extension assembly 106 were in an extended configuration corresponding to extension apertures 120B-F.

While the example shown in FIG. 1 does illustrate the stock extension assembly 106 in a maximum collapsed position corresponding to alignment of pin 108 with the extension aperture 120A, the pin 108 is not actually shown as disposed within the extension aperture 120A. As is shown in FIG. 1, and in following figures in more detail, the insert 116 prevents engagement of the pin 108 with the extension aperture 120A, and with any extension aperture that does not have a corresponding insert aperture, as explained below in more detail. This facilitates rapid extension of the stock 100 to a preferred length selected through use of the insert 116.

Specifically, in this example, the insert 116 is a plate that includes a single insert aperture 124 that aligns with extension aperture 120B. The otherwise solid insert 116 prevents engagement of the pin 108 of the detent mechanism 104 with any of the extension apertures except extension aperture 120B.

However, absent any other feature on the insert 116, this configuration does allow for unintentional extension. For example, the weight of the firearm itself, when slung from a user's body via a strap, can cause the stock extension assembly 106 to extend to an extended position as the pin 108 slides across the surface of the insert 116 until it lodges in the extension aperture 120B exposed by corresponding insert aperture 124. To prevent unintentional extension, the pin 108 is releasably maintained in its position by a distal end detent feature 128. The distal end detent feature 128 is, in this example, a positive contour (also referred to as a positive salient) disposed on a surface of the insert 116 that confronts the pin 108, thus providing a barrier at which the pin 108 catches. Because the distal end detent feature 128 and the pin 108 contact one another, unintentional movement of the stock extension assembly 106 is inhibited. However, a user may apply additional force for the pin 108 to overcome the barrier provided by the distal end detent feature 128. The additional force used to overcome the distal end detent feature 128 is, in part, a function of the urging force provided by a spring (not shown) on the pin 108 in the detent mechanism 104, the height and width of the distal end detent feature 128, the coefficient of friction between the pin 108 and the distal end detent feature 128, among other factors. The values of these factors, and other factors, can be adjusted so as to specify the additional force needed to extent the stock extension assembly 106 from the maximum collapsed configuration to an extended configuration by overcoming the barrier of the distal end detent feature. This improves the speed and decreases the effort and manual coordination needed to extend the stock extension assembly 106 to a length preferred by the user.

Figure 2:
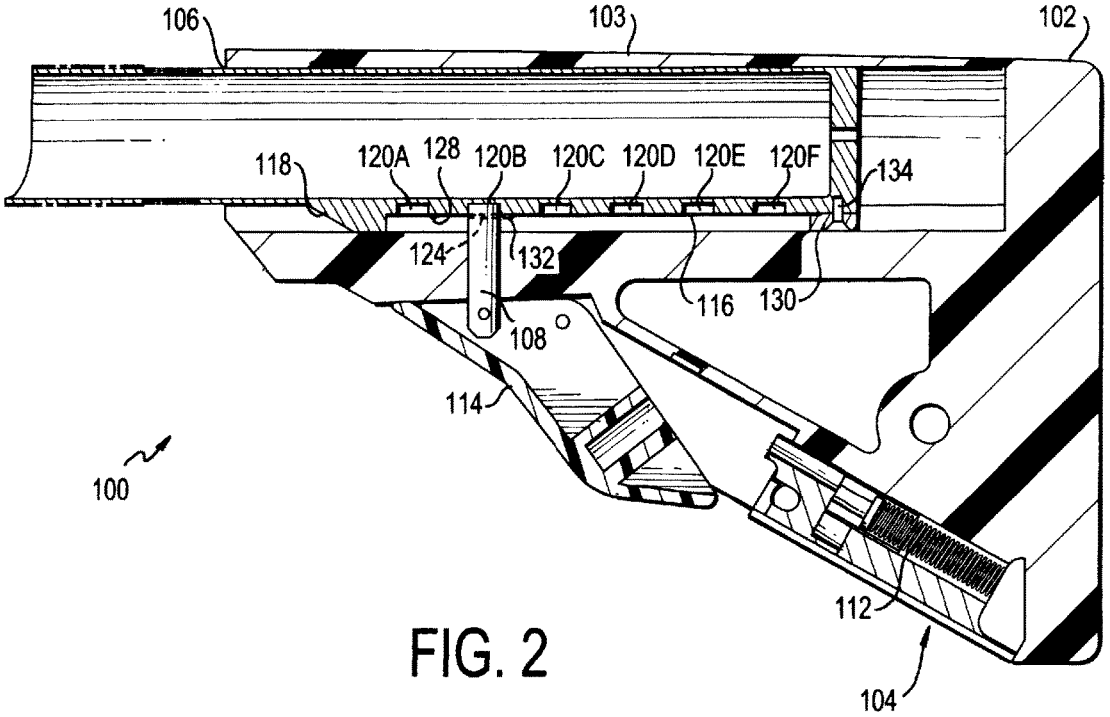
FIG. 2 is a transparent side-view of the firearm of FIG. 1 that includes a firearm stock extension assembly that is in an expanded configuration, in an embodiment.

FIG. 2 is a transparent side-view of the firearm of FIG. 1 that includes a firearm stock extension assembly that is in an extended configuration, in an embodiment. In this example, the distal end detent feature 128 has been overcome without actuation of the actuator 114. The pin 108 has engaged with extension aperture 120B (defined by the frame 118) that is exposed by the insert aperture 124 of the insert 116. As will be explained in more detail below, a proximal detent feature 132 is a positive feature of the surface of the insert 116 that prevents extension of the extension assembly 106 beyond the preferred length corresponding to the insert aperture 124.

In both FIGS. 1 and 2, an end cap 130 and screw 134 secure the insert 116 within the frame 118, as will be described in more detail below.

Firearm Stock Extension Assembly

Figure 3A:
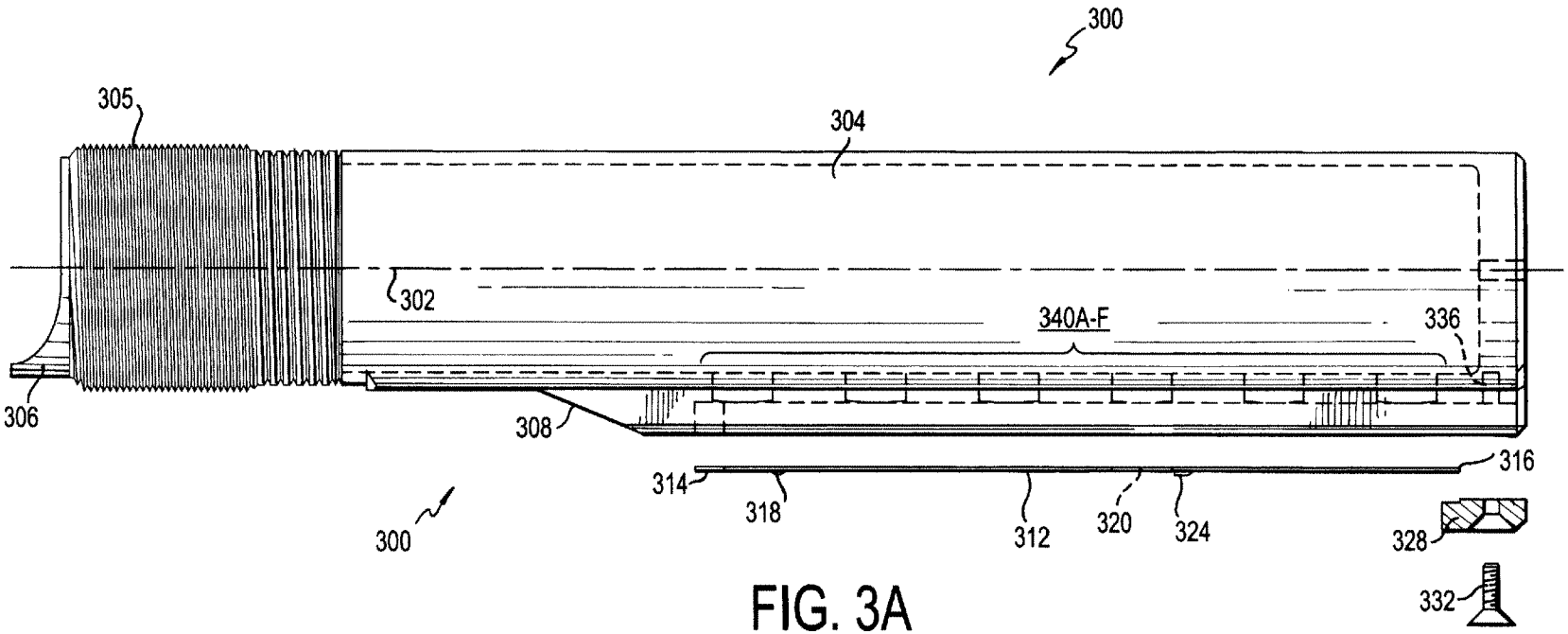
FIG. 3A is a side view of components of a firearm stock extension assembly, in an embodiment.
Figure 3B:
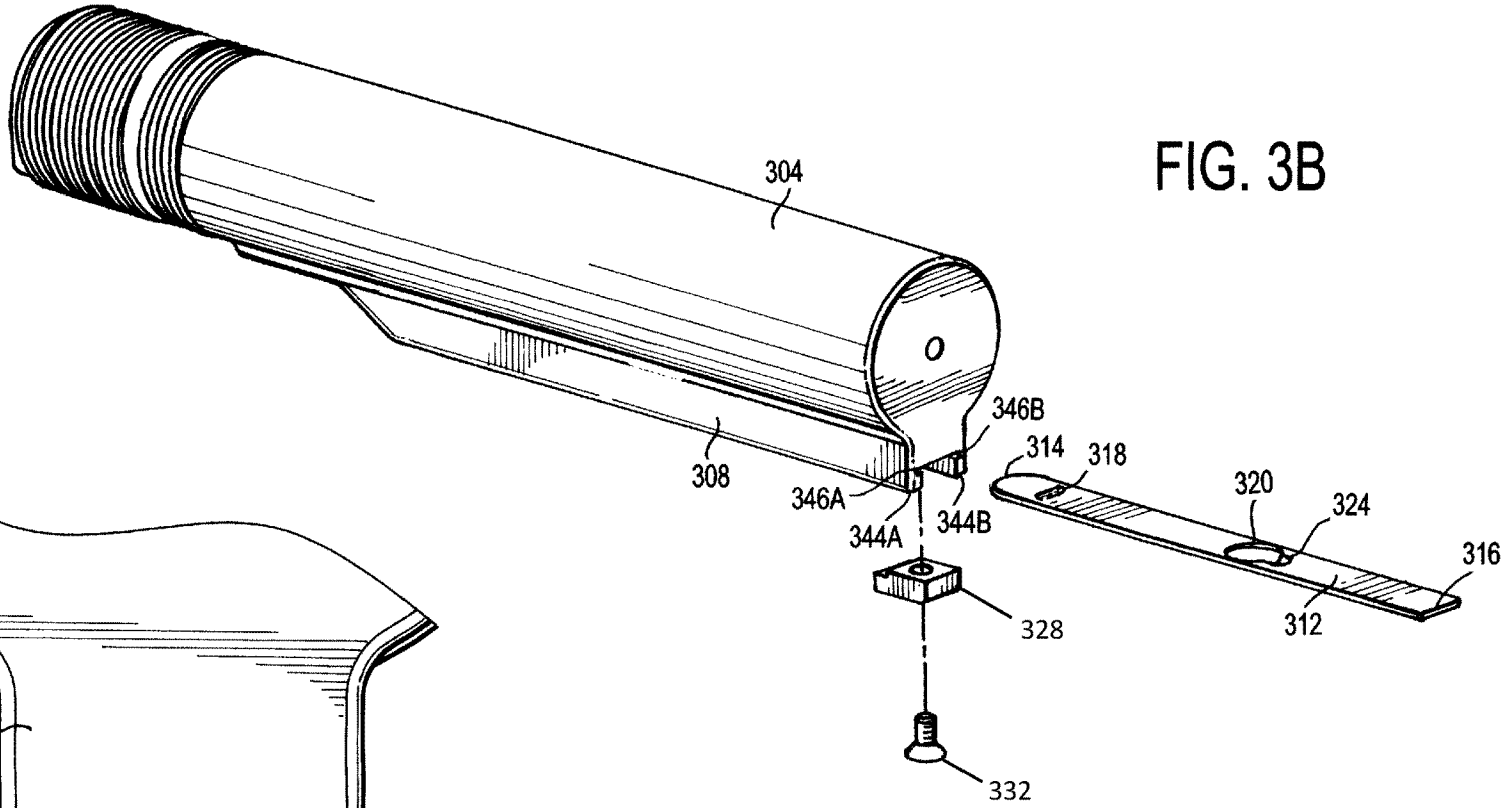
FIG. 3B is an exploded end-perspective view of a firearm stock extension assembly, in an embodiment.
Figure 3B:
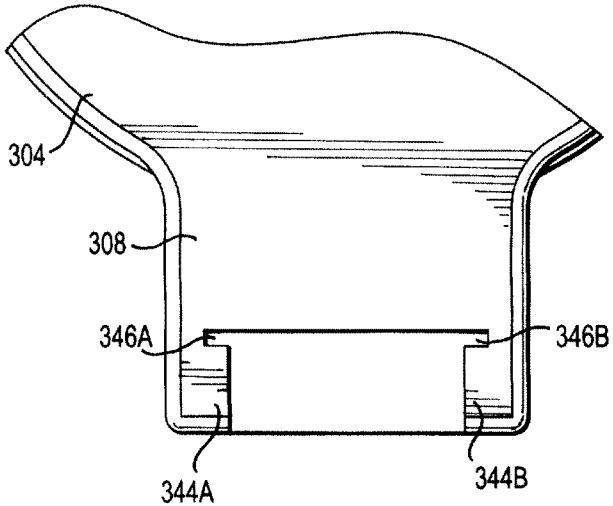
Figure 3C:
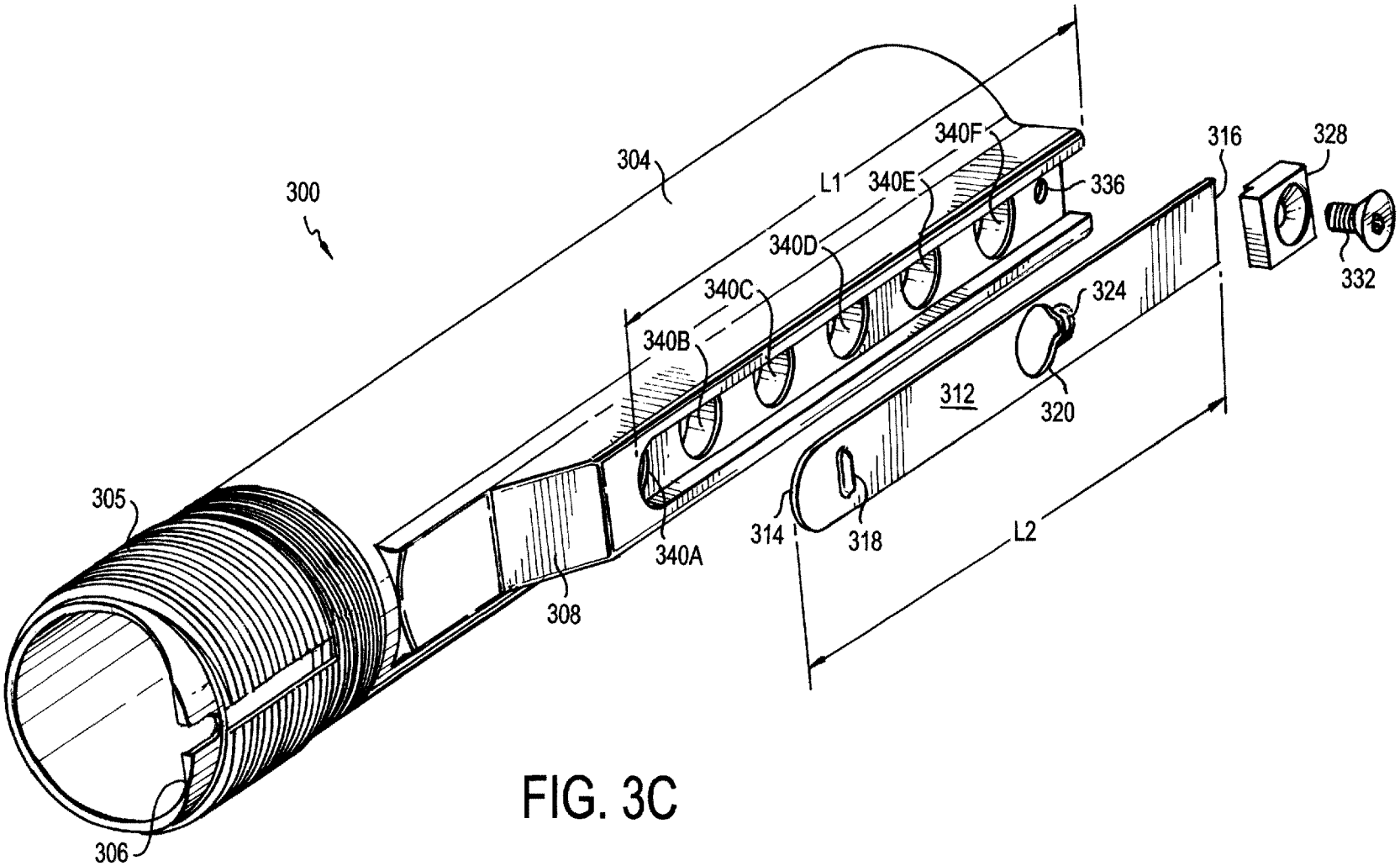
FIG. 3C is an exploded bottom-perspective view of a firearm stock extension assembly, in an embodiment.

FIGS. 3A-3C illustrate various views of an embodiment of a firearm stock extension assembly 300. Turning first to FIG. 3A, the firearm stock extension assembly 300 includes a stock extension 304, a frame 308, an insert 312, an end cap 328, and a screw 332.

The stock extension 304 is a structure than enables a stock to be moved closer to or further from other elements of a firearm (e.g., the elements that contain and fire a bullet, such as a firing chamber, a firing pin, a magazine), thus adjusting an LOP. In the embodiment shown in FIG. 3A, the stock extension 304 is a tube of metal, plastic, or composite material (e.g., plastic and carbon fibers, filled polymer). In other embodiments, planar (e.g., a flat metal, plastic, or composite) and angular (e.g., an appropriately dimensioned and configured I-beam of metal, plastic, or composite) stock extensions may also be substituted for the embodiment shown.

The stock extension 304 includes a longitudinal axis 302 that corresponds to a direction or a component of a direction of travel of the stock during adjustment of the LOP. In the example shown, the longitudinal axis 302 of the stock extension 304 is parallel to a direction of travel when extending the stock. The stock extension also includes, in this embodiment, a threaded end 305 configured to removably connect to a corresponding threaded mount on a firearm.

The embodiments shown of the stock extension 304 also includes a tapered lip 306. This tapered lip enables a bolt carrier group to rest within tube embodiments of the stock extension 304, improving the physical transitions between stages of firing a bullet and re-loading a firing chamber with a new bullet from a magazine.

The frame 308 shown in FIG. 3A is connected to, mounted on, or integral with the stock extension 304. The frame 308 defines a plurality of extension apertures 340A-F shown in the side-transparent view of FIG. 3A. Each of the extension apertures defined by the frame 308 is configured to receive a pin of a detent mechanism that is associated with a firearm stock (such as the detent mechanism 104 shown in FIGS. 1 and 2). As described above, the extension apertures 340A-F, the pin (not shown), and other features described above cooperatively function to releasably fix the stock at a location along the stock extension 304, thus allowing the firearm stock to be extended or collapsed along the length of stock extension 304.

The insert 312 of the firearm stock extension assembly 300 includes a distal end 314, a proximal end 316, a distal end detent feature 318, and a proximal end detent feature 324. The insert 312 defines an insert aperture 320.

The insert aperture 320 is defined by the insert 312 so that, when the insert 312 is placed the frame 308 (as explained below in the context of FIG. 3B), the insert aperture 320 aligns with one of the extension apertures 340A-F defined by the frame 308. This has the effect of preventing any of the extension apertures 340A-F except those exposed by the insert aperture 320 from receiving a pin of the detent mechanism described above. That is, only those extension apertures 340A-F exposed by the one or more insert apertures 320 can receive the pin that will fix the stock at a desired location on the stock extension 304.

An example of structures that can be used to place the insert 312 into the frame 308 appears in FIG. 3B and FIG. 3B'. The embodiment of the frame 308 shown includes rails 344A and 344B that, together with other portions of the frame 308, define channels 346A and 346B. The channels are dimensioned and configured to receive the insert 312. Upon insertion of the insert 312 into the channels 346A and 346B, all extension apertures 340A-F of the frame are concealed, except those (whether one or more) exposed by the insert aperture 320. It is the exposed extension aperture (or apertures) that functions to receive a pin associated with a detent mechanism of a stock.

Returning to FIG. 3A, the embodiment of the firearm stock extension assembly 300 shown includes an end cap 328 and a screw 332. The end cap 328 is connected to the stock extension 304 using the screw 332 that is passed into a through-hole in the end cap 328 and inserted into a threaded hole 336 in the frame 308. Once the end cap 328 is connected to the frame 308, the insert 312 is fixed in place within the channels 346A and 346B. It will be appreciated that other mechanisms for releasably attaching the insert 312 to the frame 308 and/or to the stock extension 304 itself may also be used. It will also be appreciated that various combinations of threaded holes and non-threaded holes can be used in the end cap 328 and the threaded hole 336.

FIG. 3C is a perspective view of the firearm stock extension assembly 300 embodiment shown in FIG. 3A. As shown in FIG. 3C, the length $L_1$ of the frame 308 is slightly greater than the length $L_2$ of the insert 312. In this embodiment, the slightly shorter length $L_2$ of the insert 312 permits threaded hole 336 to remain exposed even when the insert 312 is disposed within the channels 346A and 346B of the frame 308.

Figure 4:
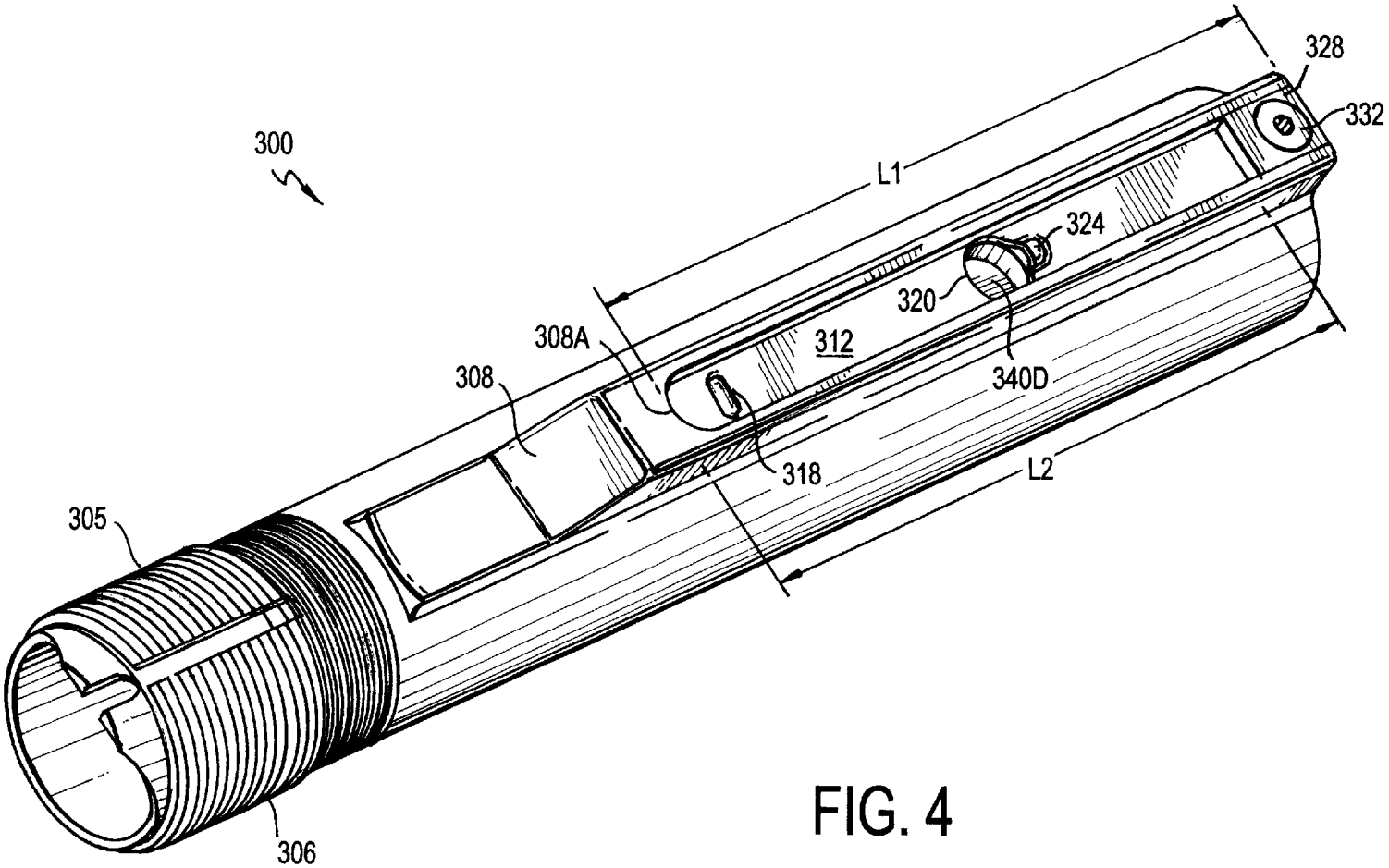
FIG. 4 is a bottom view of an assembled firearm stock extension assembly, in an embodiment.

As shown in FIG. 4, the difference in lengths of $L_1$ and $L_2$ allows the end cap 328 to be situated at the end the frame 308 and fixed into position with the screw 332, thus locking the insert 312 into place so that insert aperture 320 of the insert 312 is aligned with a corresponding one of the extension apertures 340A-F (in this case 340D). In other embodiments, in which a mechanism other than the end cap 328, the screw 332, and the threaded hole 336 are used to fix the insert 312 within the frame 308, the relative lengths $L_1$ of the frame 308 and $L_2$ of the insert 312 can be varied.

As explained above, FIG. 4 illustrates the concealment by the insert 312 of all but one of the extension apertures (i.e., 340D). It will be appreciated that other embodiments of the insert 312 may include more than one insert aperture 320. For example, to provide flexibility and convenience to a user or a provider of inserts 312, some embodiments may include two more adjacent insert apertures 320 that allow a user to select between proximate extension apertures and correspondingly, slightly different lengths of stock extension (and by implication, slightly different LOPs).

FIG. 4 also shows the distal end detent feature 318 and the proximal end detent feature 324 disposed on the insert 312 within the frame 308. As described above, the distal end detent feature 318 is configured to provide physical resistance to a pin associated with a detent mechanism of a stock. In the collapsed configuration of the stock extension (as shown in FIG. 1), the pin is urged (by for example, a spring, not shown) against the insert 312 between an end 308*a* of the frame 308 and the distal end detent feature 318. Because the pin is confined between the closed frame end (opposite threaded hole 336) and the distant end detent feature 318, the unintentional extension of the stock is resisted.

As also described above, the proximal end detent feature 324 is configured to provide resistance to extension of an extendable stock beyond the extension aperture 340D exposed by the insert aperture 320. The proximal end detent feature 324, much like the distal end detent feature 318, is configured to provide physical resistance to the pin of the detent mechanism of an extendable stock (shown in FIG. 1), thus preventing over-extension of the stock beyond the desired length. Examples of proximal and distant end detent features are described below in the context of FIG. 6.

Insert

FIGS. 5A-5E each illustrate an embodiment of an insert, analogous to the insert 312. Each of the embodiments shown is dimensioned and configured (e.g. having a length, width, thickness, and shape (including the shape of edges and corners) to fit within a frame of a firearm stock extension assembly dimensioned and configured to receive the insert. Furthermore, the embodiments of the insert shown in FIGS. 5A-5E each include a single insert aperture located at a different location along length $L_2$ of the insert. As a result, each insert exposes a different extension aperture 340A-F when inserted into the frame 308 of the stock extension assembly 300, as described above.

Figure 5E:
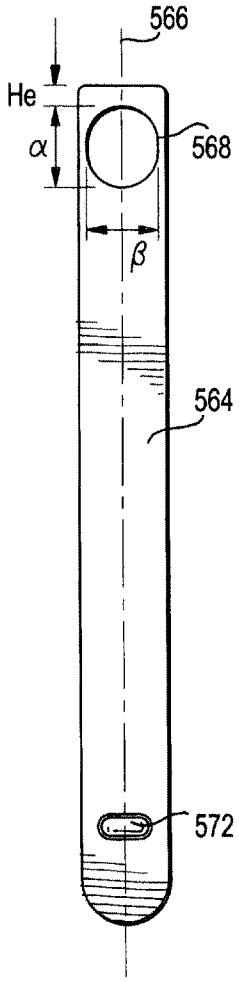
FIGS. 5A-E are plan views of inserts of a firearm stock extension assembly, in embodiments.
Figure 5D:
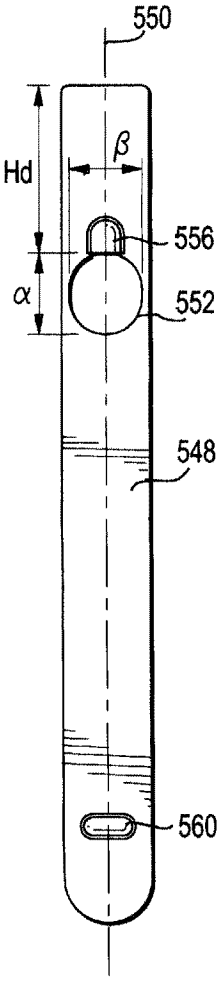
Figure 5C:
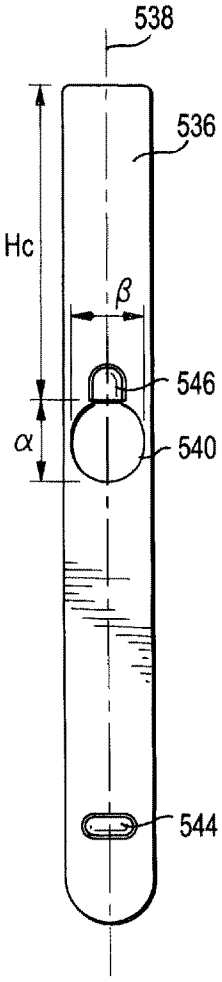
Figure 5B:
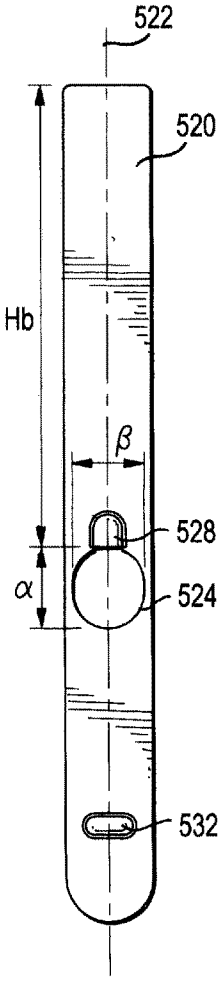
Figure 5A:
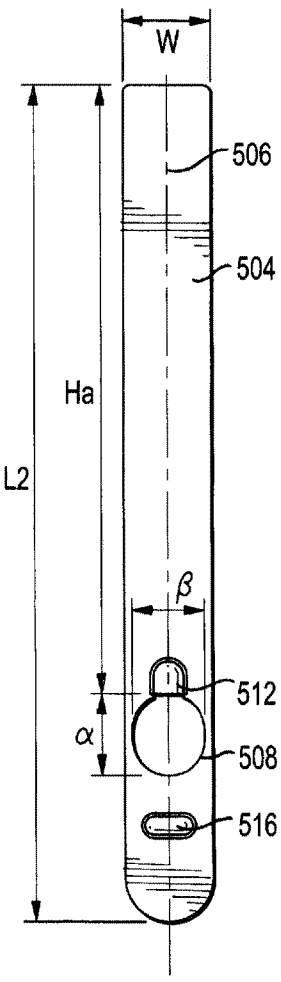

For example, the example insert 504 shown in FIG. 5A has a longitudinal axis 506 and defines insert aperture 508. The insert 504 also includes a proximal end detent feature 512 and a distal detent feature 516. Analogous proximal end detent features 528, 546, and 556 are shown on inserts 520, 536, and 548. Analogous distal end detent features 532, 544, 560, and 572 are shown on inserts 520, 536, 548, and 564. The insert 504 has a length $L_2$ (as do inserts 520, 536, 548, and 564) and width W (as do inserts 520, 536, 548, and 564). While the lengths and widths can be selected to fit within one or more types of corresponding frames, example ranges of lengths $L_2$ for the example inserts 504, 520, 536, 548, and 564 shown include from 5 cm to 15 cm, from 5 cm to 10 cm, from 7 cm to 10 cm, in embodiments. Example ranges of widths include from 0.5 cm to 2 cm, from 0.7 cm to 1.5 cm, from 0.8 cm to 1 cm, in embodiments.

The insert aperture 508 is defined by an elliptical perimeter in which a major axis of the ellipse is parallel to the longitudinal axis 506. This is also the case for insert apertures 524, 540, 552, and 568, which each have a major axis of an ellipse parallel to corresponding longitudinal axes 522, 538, 550, and 566, respectively. That is, a length a of the insert aperture 508 is greater than a width β. Example ranges of length a include: from 0.5 cm to 1.5 cm, from 0.5 cm to 1.0 cm, and 0.7 cm to 1.0 cm. Example ranges of width β include: from 0.5 cm to 1.5 cm, from 0.5 cm to 1.0 cm, and 0.7 cm to 1.0 cm. In embodiments α can be greater than β by from 5% to 20%, from 5% to 15%, from 7% to 15%, from 10% to 15%, from 12% to 13%. This elliptical elongation provides additional space in the direction in which the stock is extended (i.e., parallel to the previously indicated longitudinal axes, thus improving the ability of the pin of the stock detent mechanism to slide into the hole even when the stock is extended rapidly and/or with great force.

As shown in FIGS. 5A to 5E, each insert aperture 508, 524, 540, 552, and 568, respectively, is disposed at a different location on the corresponding insert as measured by corresponding distance $H_a$, $H_b$, $H_c$, $H_d$, $H_e$, from an end of the corresponding insert. Each of these distances $H_a$, $H_b$, $H_c$, $H_d$, $H_e$, locates the corresponding insert aperture 508, 524, 540, 552, and 568 so that, upon insertion, each insert exposes a different extension aperture. In one example, the aperture 508 of insert 504 exposes only extension aperture 340A. In other examples, the aperture 524 of insert 520 exposes only extension aperture 340B; the aperture 540 of insert 536 exposes only extension aperture 340C; the aperture 552 of insert 548 exposes only extension aperture 340D; and the aperture 568 of insert 564 exposes only extension aperture 340E. As indicated above, other insert embodiments may have more than one insert aperture to expose more than one extension aperture.

Figure 6:
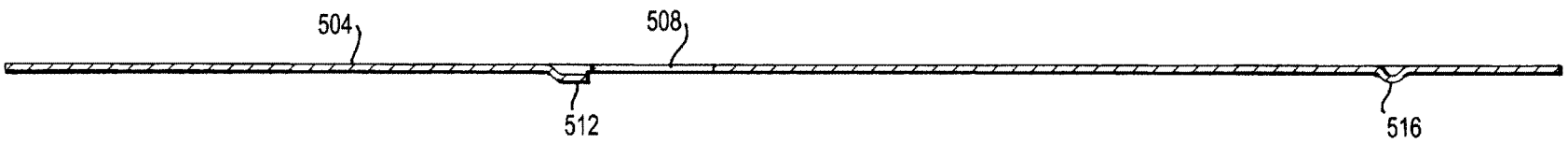
FIG. 6 is a side view of an insert of a firearm stock extension assembly, in an embodiment.

Examples of both the distal end detent feature 516 and the proximal end detent feature 512 of insert 504 are shown in a side view of FIG. 6. In this example, both detent features 512 and 516 have been pressed from the material used to fabricate the insert 504. Detent features 512 and 516 can be fabricated in other ways, such as attaching (e.g., welding, gluing) a structurally distinct feature onto the insert 504. In the example shown, the distal end detent feature 516 and the proximal end detent feature 512 extend different distances beyond a surface of the insert 504, with proximal end detent feature 512 extending further from the surface. This is to provide a greater resistance to overextending a stock (as described above) beyond a desired length of the stock extension compared to the resistance to unintentionally extending the stock from a collapsed configuration.

While the dimensions of the detent features can be selected based on the user, the size and weight of the firearm for which the stock extension assembly is used, and the size and/or strength of the user, in the example shown in FIG. 6, the pressed (or stamped) distal end detent feature 516 is from 0.2 mm to 0.7 mm above the surface of the insert 504. The pressed or stamped proximal end detent feature 512 is from 0.7 mm to 1.1 mm above the surface of the insert 504. Width (in the plane of the surface of the insert parallel to the width W and perpendicular to the longitudinal axis 506) and length of both of the detent features can also be configured based on the parameters indicated above as well as on the dimensions of the pin of the detent mechanism associated with a stock. In the example shown, the width of each feature is from 5 mm to 10 mm and the length is from 1 mm to 3 mm.

Summary

The foregoing description of the embodiments of the disclosure has been presented for the purpose of illustration; it is not intended to be exhaustive or to limit the claims to the precise forms disclosed. Persons skilled in the relevant art can appreciate that many modifications and variations are possible in light of the above disclosure.

The language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the invention, which is set forth in the following claims.

What is claimed is:

1. A firearm stock extension assembly comprising:

a stock extension having a longitudinal axis;

an extension frame connected to the stock extension, the extension frame defining:

two channels parallel to the longitudinal axis of the stock extension;

a plurality of extension apertures; and an insert configured to be removably disposed within the two channels of the extension frame in a direction parallel to the longitudinal axis of the stock extension, the insert defining at least one insert aperture configured to align with at least one of the plurality of extension apertures upon insertion of the insert into the two channels parallel to the longitudinal axis of the stock extension.

2. The firearm stock extension assembly of claim 1, wherein the insert further comprises:

a distal end;

a proximal end proximate to a user contact surface of a firearm stock, the proximal end opposite the distal end; and a first positive salient feature disposed proximate to the distal end of the insert, the first positive salient feature configured to deter unintentional extension of the firearm stock extension assembly.

3. The firearm stock extension assembly of claim 1, wherein the insert further comprises:

a distal end;

a proximal end proximate to a user contact surface of a firearm stock, the proximal end opposite the distal end; and at least one second positive salient feature, each of the at least one second positive salient features disposed adjacent to a corresponding one of the at least one insert apertures and between the corresponding insert aperture and the proximal end, wherein each of the at least one second positive salient features is configured to deter unintentional over-extension of the firearm stock extension assembly beyond the corresponding at least one insert aperture.

4. The firearm stock extension assembly of claim 1, further comprising an end cap configured to mount to an open end of the two channels defined by the extension frame.

5. The firearm stock extension assembly of claim 4, wherein:

the extension frame defines a threaded hole proximate to the open end; and the end cap defines a through-hole configured to align with the threaded hole when the end cap is mounted to the open end of the two channels.

6. The firearm stock extension assembly of claim 1, wherein each of the at least one insert apertures defined by the insert are ellipses, a major axis of each ellipse parallel to the longitudinal axis of the stock extension.

7. The firearm stock extension assembly of claim 1, wherein each extension aperture of the plurality and each of the at least one insert apertures are configured to receive a pin of a stock detent mechanism that, when received by an extension aperture aligned with an insert aperture, locks the stock extension into a position corresponding to the extension aperture.

8. An adjustable firearm stock assembly comprising:

an adjustable stock comprising:

a stock;

a chamber disposed within the stock;

a detent mechanism comprising a pin;

a stock extension configured to be at least partially disposed within the chamber of the adjustable stock, the stock extension having a longitudinal axis;

an extension frame connected to the stock extension, the extension frame defining:

two channels parallel to the longitudinal axis of the stock extension;

a plurality of extension apertures; and an insert configured to be removably disposed within the two channels of the extension frame in a direction parallel to the longitudinal axis of the stock extension, the insert defining at least one insert aperture configured to align with at least one of the plurality of extension apertures upon insertion of the insert into the two channels parallel to the longitudinal axis of the stock extension.

9. The adjustable firearm stock assembly of claim 8, wherein the insert further comprises:

a distal end;

a proximal end proximate to a user contact surface of the stock, the proximal end opposite the distal end; and a first positive salient feature disposed proximate to the distal end of the insert, the first positive salient feature configured to deter unintentional extension of the adjustable firearm stock assembly.

10. The adjustable firearm stock assembly of claim 8, wherein the insert further comprises:

a distal end;

a proximal end proximate to a user contact surface of the stock, the proximal end opposite the distal end; and at least one second positive salient feature, each of the at least one second positive salient features disposed adjacent to a corresponding one of the at least one insert apertures, and between the corresponding insert aperture and the proximal end, wherein each of the at least one second positive salient features is configured to deter unintentional over-extension of the adjustable firearm stock assembly beyond the adjacent corresponding at least one insert aperture.

11. The adjustable firearm stock assembly of claim 8, further comprising an end cap configured to mount to an open end of the two channels defined by the extension frame.

12. The adjustable firearm stock assembly of claim 11, wherein:

the extension frame defines a threaded hole proximate to the open end; and the end cap defines a through-hole configured to align with the threaded hole when the end cap is mounted to the open end of the two channels.

13. The adjustable firearm stock assembly of claim 8, wherein each of the at least one insert apertures defined by the insert are ellipses, a major axis of each ellipse parallel to the longitudinal axis of the stock extension.

14. The adjustable firearm stock assembly of claim 8, wherein each extension aperture of the plurality and each of the at least one insert apertures are configured to receive the pin of the detent mechanism that, when received by an extension aperture aligned with an insert aperture, locks the stock extension into a position corresponding to the extension aperture.

15. A firearm comprising:

a firing chamber;

a firing pin proximate to the firing chamber;

a trigger connected to the firing pin;

an adjustable stock comprising:

a stock;

a chamber disposed within the stock;

a detent mechanism comprising a pin;

a stock extension configured to be at least partially disposed within the chamber of the adjustable stock, the stock extension having a longitudinal axis;

an extension frame connected to the stock extension, the extension frame defining:

two channels parallel to the longitudinal axis of the stock extension;

a plurality of extension apertures; and an insert configured to be removably disposed within the two channels of the extension frame in a direction parallel to the longitudinal axis of the stock extension, the insert defining at least one insert aperture configured to align with at least one of the plurality of extension apertures upon insertion of the insert into the two channels parallel to the longitudinal axis of the stock extension.

16. The firearm of claim 15, wherein the insert further comprises:

a distal end;

a proximal end proximate to a user contact surface of the stock, the proximal end opposite the distal end; and a first positive salient feature disposed proximate to the distal end of the insert, the first positive salient feature configured to deter unintentional extension of the adjustable stock.

17. The firearm of claim 15, wherein the insert further comprises:

a distal end;

a proximal end proximate to a user contact surface of the stock, the proximal end opposite the distal end; and at least one second positive salient feature disposed adjacent to a corresponding one of the at least one insert apertures and between the corresponding insert apertures and the proximal end, wherein each of the at least one second positive salient feature is configured to deter unintentional over-extension of the adjustable stock beyond the adjacent corresponding at least one insert aperture.

18. The firearm of claim 15, wherein each of the at least one insert apertures defined by the insert are ellipses, a major axis of each ellipse parallel to the longitudinal axis of the stock extension.

19. The firearm of claim 15, wherein each extension aperture of the plurality and each of the at least one insert apertures are configured to receive the pin of the detent mechanism that, when received by an extension aperture aligned with an insert aperture, locks the stock extension into a position corresponding to the extension aperture.

* * * * *